US005921003A

United States Patent [19]

Kim

[11] Patent Number: 5,921,003

[45] Date of Patent: Jul. 13, 1999

[54] SHOE WITH REPLACEABLE HYGIENIC CARTRIDGE

[76] Inventor: Insop Kim, 4-21 Schorr Dr., College Point, N.Y. 11356

[21] Appl. No.: 08/969,797

[22] Filed: Nov. 13, 1997

Related U.S. Application Data

[60] Provisional application No. 60/031,121, Nov. 18, 1996.

[51] Int. Cl.[6] ..... A43B 7/06; A43B 23/00

[52] U.S. Cl. ..... 36/3 B; 36/136

[58] Field of Search ..... 36/3 R, 3 B, 136

[56] References Cited

U.S. PATENT DOCUMENTS

| | | | |
|---|---|---|---|
| 2,266,476 | 12/1941 | Riess | 36/3 R |
| 2,442,026 | 5/1948 | Thompson, Jr. | 36/3 R |
| 2,902,781 | 9/1959 | Rando . | |
| 4,063,371 | 12/1977 | Batra . | |
| 4,327,056 | 4/1982 | Gaiser | 422/124 |
| 4,617,745 | 10/1986 | Batra | 36/3 B |
| 4,771,555 | 9/1988 | Ohashi . | |
| 4,950,457 | 8/1990 | Weick | 422/123 |
| 5,035,068 | 7/1991 | Biasi . | |
| 5,148,949 | 9/1992 | Luca | 36/136 |
| 5,261,169 | 11/1993 | Williford . | |
| 5,367,788 | 11/1994 | Chen . | |
| 5,477,626 | 12/1995 | Kwon . | |

*Primary Examiner*—M. D. Patterson
*Attorney, Agent, or Firm*—Richard C. Litman

[57] ABSTRACT

A shoe with a replaceable hygienic cartridge in the heel portion thereof, forces a chemical agent through the shoe due to the intermittent compression or pumping action while a wearer of the shoe is walking, running, or using the shoe in a similar manner. The shoe includes a chemical cartridge chamber in the heel portion of the sole, into which a flexible and resilient cartridge is removably installed. The cartridge may contain any of a number of different materials or agents, such as deodorant, anti-bacterial, fungicidal, desiccant, etc., or various combinations thereof; as desired. The upper surface of the sole within the shoe contains a series of grooves or channels therein, which communicate with the cartridge chamber by a passage therebetween. A porous insole overlays the upper surface of the sole and its channels. When the shoe is worn, the intermittent compression of the heel at the beginning of each step also compresses the cartridge, forcing a portion of the material therein upwardly through the passage and channels in the upper surface of the sole, where the material is diffused through the porous insole into the interior of the shoe beneath the sole of the wearer's foot. The cartridge is quickly and easily replaced when the material therein is dissipated. The arrangement may be adapted to virtually any type of footwear, but is particularly well suited for athletic shoes having relatively soft and resilient heels, to compress the cartridge more readily.

19 Claims, 3 Drawing Sheets

SHOE WITH REPLACEABLE HYGIENIC CARTRIDGE

CROSS-REFERENCE TO RELATED APPLICATION

This application claims the benefit of U.S. Provisional Patent Application Ser. No. 60/031/121, filed Nov. 18, 1996.

BACKGROUND OF THE INVENTION

1. Field of the Invention

The present invention relates generally to footwear, and more particularly to a shoe which is adapted to hold a replaceable cartridge in the heel thereof. The cartridge may contain any one of a number of different ingredients (deodorants, fungicides, etc.), with the cartridge chamber communicating with the upper surface of the shoe sole and insole. The natural alternating compressive pumping action of the heel during walking, running, and similar activities, causes the cartridge ingredients to be forced throughout the shoe to deodorize or otherwise beneficially affect the shoe.

2. Description of the Related Art

It is well known that certain odor producing bacteria perform most efficiently in conditions of relatively high moisture and warmth, conditions generally found in the average shoe while it is being worn. Other clothing generally "breathes" better than does footwear, resulting in better circulation to reduce the ambient moisture, and also gradually dissipating any resulting odor which may be produced by such bacteria, to an unnoticeable degree. However, foot and shoe odors are considered to be a nagging problem to most persons, particularly as the importance of personal hygiene has been recognized over the years.

Accordingly, various products and methods have been developed to fight such problems, such as shoe inserts, foot and shoe sprays, etc. While these products do assist in fighting the problem to a certain degree, they are not well adapted to provide a continuing solution. Foot and shoe sprays are stopgap measures which generally do not last for the entire time during which the shoes are being worn, and are generally too strong during the first part of the period of application and weaken to the point of ineffectiveness by the time the shoes are removed. Treated insoles are costly, as they are not particularly adapted for the carriage of deodorants, fungicides, etc., but rather are primarily adapted for comfort. The addition of the appropriate chemicals to a removable insole, adds further to the cost of such insoles, and moreover they must be replaced in their entirety each time a new treatment for the shoe is desired.

Specifically, U.S. Pat. No. 2,902,781 issued on Sep. 8, 1959 to Frank Rando describes Shoe Insoles having a semicircular arch support secured beneath the insole. The insoles are perforated for circulation, but no means of introducing a deodorant or other substance through the insole is disclosed, which feature is provided by the present invention.

U.S. Pat. No. 4,063,371 issued on Dec. 20, 1977 to Vijay Batra describes an Air-Flow Shoe, having a plurality of passages through the outer sole, a filler within the shoe, and an insole overlying the filler. The shoe promotes air circulation to the sole of the foot, but no means is provided for the introduction of deodorant or other substance into the shoe. Moreover, the Batra shoe sole is not waterproof, as is the present shoe sole.

U.S. Pat. No. 4,771,555 issued on Sep. 20, 1988 to Kazuo Ohashi describes a Waterproof Boot Having Ventilation Means, comprising a ski boot having a plurality of air passages in the instep and/or sole areas of the boot. The air passages include a waterproof, but air permeable, disc of porous synthetic fabric material. As in the Batra shoe discussed above, Ohashi provides for air flow into the shoe or boot interior by direct passages through the sole or side of the footwear, unlike the present shoe. Moreover, Ohashi fails to provide any means for introducing any deodorant or other chemical substance into the interior of the boot while it is being worn, as provided by the present invention.

U.S. Pat. No. 5,035,068 issued on Jul. 30, 1991 to Franco A. Biasi describes a Shoe And Removable Shoe Insole System, with a lower sheet having a plurality of short compressible columns overlaid with a perforated upper insole. Air is able to circulate between the two sheets and to enter the shoe through the perforated upper insole. One way vents are provided on each side of the shoe near the heel, but Biasi describes his vents as being closed when the heel is compressed and open when weight is removed from the heel (column 6, lines 33–44) to cause flow from the sole when the heel is lifted, rather than forcing material through the sole when pressure is applied to the heel, as in the present shoe. Biasi also provides for the surfaces between the insole sheets to be coated with a deodorant, etc.; but, the relatively costly insole assembly must be discarded when the material is dissipated, unlike the present shoe with its easily replaceable and inexpensive cartridge.

U.S. Pat. No. 5,261,169 issued on Nov. 16, 1993 to John H. Williford describes a System And Method For Deodorant Delivery In Footwear. The device comprises a resilient insole sheet having a plurality of small passages therethrough, each filled with an antimicrobial agent or the like. The bottom of the insole sheet is sealed with an impervious sheet of material, while the top of the insole sheet is covered with a porous layer. The insole sheet is alternatingly compressed as the wearer of the shoe and insole walks, thereby causing the passages to discharge quantities of the chemicals therein through the upper porous sheet and into the shoe. No horizontal air passages through the insole are disclosed, nor is any means provided for replenishing the chemicals using a single cartridge supply or the like. The Williford insole must be discarded when the chemical supply is dissipated, rather than merely replacing a cartridge, as in the present invention.

U.S. Pat. No. 5,367,788 issued on Nov. 29, 1994 to Shi-Hiu Chen describes a Shoe With A Built-In Cooling Apparatus, having a compartmented sole with a piezoelectric generator in the heel portion which provides electrical power for a solid state cooling device near the toe portion. Passages are provided in the sides of the heel and toe portions for the dissipation of warm air produced by the electronic devices, but these passages also communicate with the remaining space within the sole, so it would appear that both warm and cool air would mix within the sole. In any event, Chen fails to provide any means of introducing any antimicrobial substance into the shoe, as provided by the present invention.

Finally, U.S. Pat. No. 5,477,626 issued on Dec. 26, 1995 to Joong T. Kwon describes a Multifunctional Shoe, comprising a multiple chambered heel portion with central and toroidal outer air chambers. The normally closed toroidal outer chamber may be pressurized as desired using a small hand-operated pump, as is known in other types of athletic shoes having similar features. No air circulation is provided through the outer chamber. The central chamber communicates with a passage from the toe portion of the upper sole, which includes a one way valve allowing air only into the chamber. Air exits the central chamber through an exhaust port in the side of the heel. Walking or other ambulatory activity by the wearer results in the alternate pumping compression of the central portion, to cause air to be drawn from the toe portion of the shoe interior and to exhaust through the side port in the heel, opposite the action of the present shoe, wherein material from the cartridge is forced upwardly and forwardly through the sole passages and into the shoe interior. In any event, Kwon does not disclose any means for introducing any chemical agent into his shoe, as provided by the present invention. Any chemical provided in the Kwon shoe would be discharged from the outlet in the heel, rather than being introduced into the shoe interior, as in the present invention.

None of the above inventions and patents, taken either singly or in combination, is seen to describe the instant invention as claimed.

SUMMARY OF THE INVENTION

The present invention responds to the above noted problems by providing a shoe which is adapted particularly for the removable installation of a replaceable cartridge therein. The cartridge may contain a high concentration of any of a number of different chemicals or ingredients, such as deodorants, bacteriological agents, fungicides, desiccants, etc., as desired. The cartridge is removably installed in a chamber in the heel of the shoe, which chamber communicates with a plurality of channels formed in the upper surface of the shoe sole within the shoe, by means of a passage therebetween. A perforated insole is also provided.

The natural intermittent compressive pumping action of the heel of the shoe during walking, running, etc., results in the pumping of the cartridge ingredient into the shoe by means of the chamber passage, upper sole channels, and perforated insole. The cartridge may be replaced as required, without incurring great expense. The present invention may be adapted to virtually any type of footwear (shoes, boots, etc.), but is particularly well adapted for a sneaker or athletic shoe, with its typically relatively soft and highly resilient sole and heel structure, particularly when the high cost of many such specialized athletic shoes is considered.

More specifically, when the compressive pressure is alternatingly placed upon the heel portion of the shoe, the resilient hygienic cartridge therein is compressed accordingly, causing some amount of the hygienic material (disinfectant, deodorant, fungicide, bacteriological agent, desiccant, or any combination of the above or other suitable material) to be dispensed from the cartridge. Thereupon, it is forced into the sole of the shoe through a passage between the cartridge compartment and the sole and thence through a series of channels formed in the upper surface of the sole. The hygienic material is then dispensed into the interior of the shoe through a porous insole overlying the channels in the sole. The cartridge may be easily replaced as required, when the contents of the cartridge have been depleted.

Accordingly, it is a principal object of the invention to provide an improved shoe with replaceable hygienic cartridge, providing for the distribution of a chemical agent through the shoe interior while the shoe is being worn.

It is another object of the invention to provide an improved shoe with replaceable hygienic cartridge, wherein the heel of the shoe includes a cartridge chamber therein which communicates with the upper surface of the sole by means of a passage and a plurality of channels formed in the upper surface of the sole.

It is a further object of the invention to provide an improved shoe with replaceable hygienic cartridge, wherein a porous insole may be provided to overlay the upper surface of the sole within the shoe.

An additional object of the invention is to provide an improved shoe with replaceable hygienic cartridge, wherein the cartridge comprises a flexible and resilient body portion containing deodorant, anti-bacterial, fungicidal, desiccant, and/or other chemical(s) therein, which chemicals are distributed throughout the shoe during walking or other ambulatory activity.

Still another object of the invention is to provide an improved shoe with replaceable hygienic cartridge which may be adapted to virtually any type of footwear, but which is particularly well adapted for use with athletic shoes and the like having relatively soft, resilient, and compressible heel portions.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises a shoe which is adapted to receive a replaceable cartridge in the heel portion thereof, and a replaceable cartridge therefor. The cartridge includes a hollow body with at least part of the body being porous, with the body being filled with some type of hygienic chemical (scent, deodorant, anti-bacterial, fungicidal, and/or desiccant material, each of which have been previously developed and are used in foot care and other fields). The present invention may be adapted to virtually any type of footwear, but is particularly useful with athletic shoes having sole and heel components formed as a single unit of relatively resilient material, such as the shoe 10 of FIG. 1.

Figure 2:
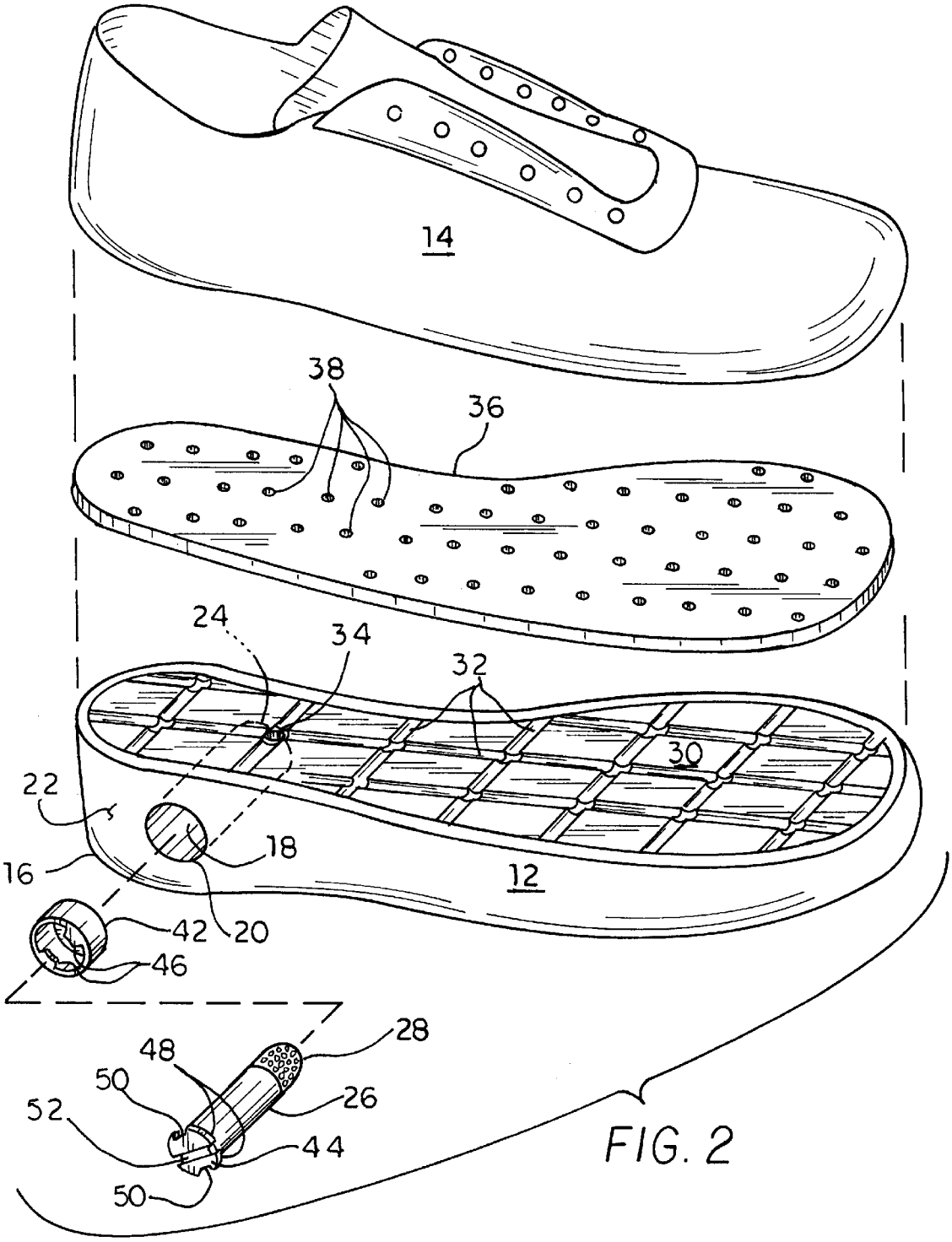
FIG. 2 is an exploded perspective view of the shoe of FIG. 1, showing the particular configuration of the sole portion thereof, the cartridge chamber, and a replaceable cartridge and retaining means therefor.

FIG. 2 provides an exploded view of such a shoe, with the unitary sole and heel portion 12 separated from the upper portion 14 for clarity. The rearward heel portion 16 includes a generally horizontally disposed cartridge chamber 18 therein, with the chamber 18 having an open cartridge insertion end 20 which communicates with the side 22 of the heel 16, and an opposite internal end 24 within the heel 16. A disposable, replaceable hygienic cartridge 26 has a hollow body portion formed of a relatively thin and pliable sheet of material (plastic, etc.), containing some form of hygienic agent or chemical therein, or a mixture thereof, as desired. At least a portion of the cartridge body is porous, such as the innermost end 28, which is positioned adjacent the internal end 24 of the chamber 18 when the cartridge 26 is installed within the heel cartridge chamber 18.

The sole and heel unit 12 has an upper surface 30 including a plurality of channels or grooves 32 formed therein, as in the longitudinal and lateral grid pattern shown in FIG. 2. Other patterns, e.g., radiating from the heel portion, etc., may be provided as desired. These channels 32 communicate with the cartridge chamber 18 by means of a passage 34 extending between the chamber 18 and at least one of the channels 32. The passage 34 is preferably formed from the internal end 24 of the chamber 18, but one or more such passages may extend from other locations along the chamber, as desired. A porous insole 36 is placed within the shoe to overlie the upper surface 30 of the sole and heel unit 12 and the channels 32 formed therein. The insole 36 is provided with a plurality of holes 38 therethrough, or is provided with porosity in some manner.

Figure 1:
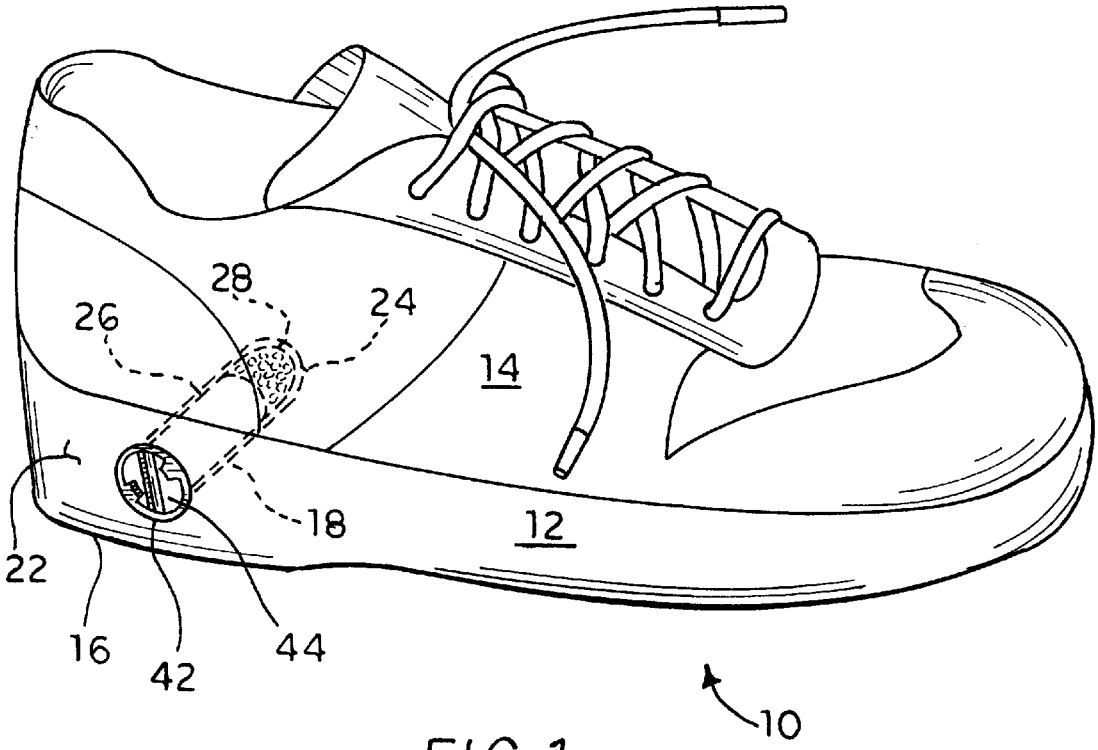
FIG. 1 is a top and side perspective view of a shoe with replaceable hygienic cartridge according to the present invention, showing the installation of a replaceable cartridge in the heel portion thereof.
Figure 3:
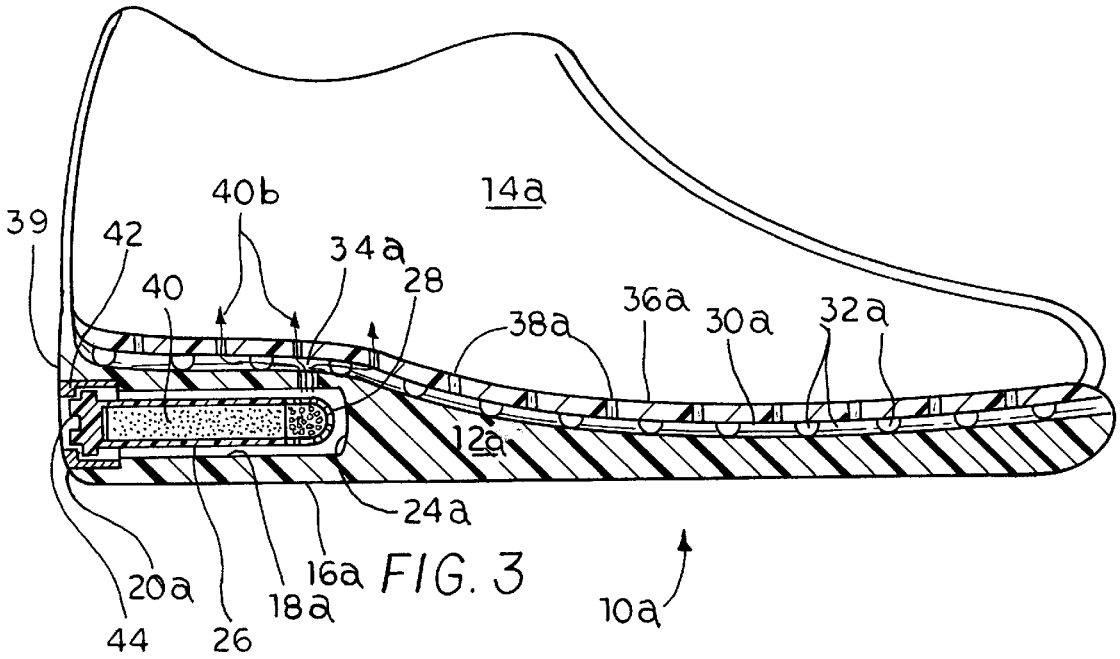
FIG. 3 is a side sectional view of an alternative embodiment shoe of the present invention, showing the cartridge and chamber disposed in the rear of the heel portion of the shoe.
Figure 4:
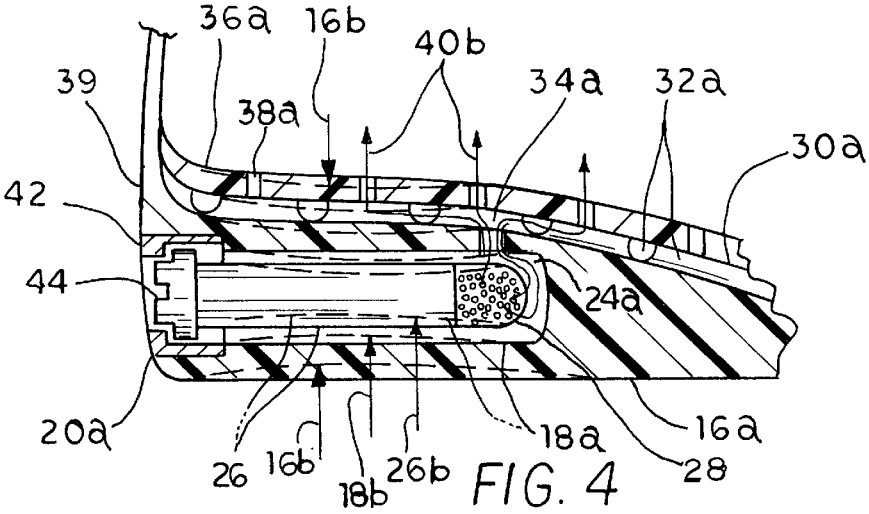
FIG. 4 is an enlarged, fragmented side sectional view of the heel portion of the shoe of FIG. 3, showing further details thereof.

FIGS. 3 and 4 provide a more detailed view of the construction of the cartridge and cartridge chamber of the present invention, as well as disclosing an alternate embodiment relating to the placement of the cartridge chamber within the heel. In FIG. 3, a shoe 10*a* has a sole/heel unit 12*a* and upper portion 14*a*. The heel 16*a* includes a cartridge chamber 18*a* therein, with the only difference between the cartridge chamber 18 of the shoe 10 and the chamber 18*a* of the shoe 10*a* being the orientation of the chambers 18/18*a*. The chamber 18*a* of the shoe 10*a* of FIG. 2, will be seen to be longitudinally disposed within the heel 16*a* and to extend from the rearward end 39 of the heel 16*a*, rather than from one of the sides 22 of the heel 16, as shown in FIGS. 1 and 2.

FIGS. 3 and 4 also provide further detail of the cartridge 26, which is the same for each of the embodiments of the present invention. As noted further above, the cartridge 26 primarily comprises a thin, hollow, and resilient body portion, with the interior thereof containing a hygienic chemical agent or material 40 therein. The cartridge 26 is locked into the chamber 18*a* (or 18, in the shoe 10 of FIGS. 1 and 2) by means of a retaining insert 42, which is permanently secured (adhesively bonded, chemically or thermally welded, etc.) into the cartridge insertion end 20 or 20*a* of the respective chamber 18 or 18*a*.

Details of the cartridge retaining insert 42, and the cooperating cartridge head 44, are shown more clearly in FIG. 2. The cartridge retaining insert 42 includes at least one inwardly directed tab 46 (and preferably two or more tabs 46). The cartridge head 44 includes a flange 48 extending outwardly therefrom, with the flange 48 having a number of slots 50 (one or more, corresponding to the number of tabs 46 of the insert 42) formed peripherally therearound. The cartridge 26 is inserted into the cartridge chamber 18 or 18*a*, with the cartridge flange slots 50 aligned with the corresponding insert tabs 46. When the cartridge head 44 has been inserted into the chamber 18 or 18*a* past the insert retaining tabs 46, the cartridge 26 may be turned slightly to capture the outwardly extending cartridge head flanges 48 behind the retaining tabs 46, thereby locking the cartridge 26 within the chamber 18 or 18*a*. A lateral slot 52 may be provided across the cartridge head 44 for manipulation of the cartridge 26.

The present shoe 10 or 10*a* and hygienic cartridge 26 operate automatically to sanitize and/or deodorize the shoe 10 or 10*a* while the wearer is engaged in any form of ambulatory activity (i.e., walking, running, jogging, or even pedaling a bicycle, etc.) where pressure is intermittently placed upon the resilient heel portion 16 or 16*a* of the shoe 10 or 10*a*, as shown by the arrows 16*b* in FIG. 4. This pressure causes the cartridge chamber 18 or 18*a* to collapse partially, as indicated by the arrow 18*b* of FIG. 4, which in turn squeezes the thin, resilient walls of the cartridge 26 body, as indicated by the arrow 26*b* in FIG. 4. (The clearance between the cartridge chamber 18*a* walls and the cartridge 26 body is exaggerated in FIG. 4, for clarity in the drawing Figure.)

The above described compression of the cartridge body 26 forces a small quantity of the hygienic agent or chemical 40 out of the cartridge 26, through the porous portion 28 of the cartridge 26. The chemical or agent 40 must escape the compression of the cartridge chamber 18 or 18*a*, and the only path available is by means of the passage 34 or 34*a* to the channels 32 or 32*a* formed in the upper surface 30 or 30*a* of the sole and heel unit 12 or 12*a*, where the chemical 40 is distributed along the channels beneath the foot of the wearer of the shoe 10 or 10*a*. At this point, the chemical is forced upwardly through the holes 38 or 38*a* in the insole 36 or 36*a* by the pressure of the wearer's foot within the shoe 10 or 10*a*, to permeate the interior of the shoe 10 or 10*a*, as shown by the arrows 40*b* in FIGS. 3 and 4. This action occurs automatically with each step or push of the heel.

When the chemical agent or agents 40 within the cartridge 26 have been depleted, the depleted cartridge 26 is easily removed by merely turning the cartridge 26 a quarter or half turn, as required, to release the captured flange 48 from beneath the tab 46 of the retainer insert 42. A fresh cartridge 26 may then be installed in the cartridge chamber 18 or 18*a*, as described further above. Alternative means of securing a cartridge 26 within the chamber 18 or 18*a* may be provided, e.g., conventional screw threads, snap in installation, etc.

In summary, the present shoe and replaceable hygienic cartridge provide an extremely economical means of retaining expensive shoes in top quality condition, and eliminating unpleasant odors due to bacteria and fungus growth. While the present invention may be adapted to virtually any type of footwear, it is particularly well adapted to athletic shoes and their relatively resilient heels, which provide for the compression of a cartridge installed therein. Many brands and types of athletic shoes can cost well over one hundred dollars, and yet many are replaced well before being worn out due to the unsanitary interior of the shoe after being worn for some time. Such shoes may have their lives extended considerably by means of the inexpensive replaceable cartridge of the present invention, thus saving the consumer considerable expense and shopping inconvenience.

It is to be understood that the present invention is not limited to the sole embodiments described above, but encompasses any and all embodiments within the scope of the following claims.

I claim:

1. Footwear with a replaceable hygienic cartridge, comprising:

a shoe having a sole, with said sole including a rearwardly disposed heel and an upper surface;

said heel including a generally horizontal cartridge chamber formed therein, with said cartridge chamber including an open cartridge insertion end and an opposite internal end;

a cartridge for hygienically treating said shoe, with said cartridge being removably installed within said cartridge chamber of said heel;

said cartridge comprising a hollow, flexible, resilient body having at least one hygienic chemical therein, with said cartridge body further being porous throughout at least a portion thereof;

said upper surface of said sole further including a plurality of channels formed therein for distributing said hygienic chemical throughout said shoe; and said heel further including an internal passage extending from said cartridge chamber to said channels in said upper surface of said sole, with said chamber communicating with said channels by means of said passage for distributing said hygienic chemical to said channels from said cartridge chamber as said at least one hygienic chemical is forced from said cartridge body by intermittent compression of said heel and said cartridge removably installed therein due to ambulatory action by a wearer of said shoe.

2. The footwear with replaceable hygienic cartridge according to claim 1, including a porous insole disposed within said shoe and overlying said upper surface of said sole and said channels thereof.

3. The footwear with replaceable hygienic cartridge according to claim 1, including cartridge retaining means for selectively and removably retaining said cartridge within said chamber.

4. The footwear with replaceable hygienic cartridge according to claim 3, wherein said cartridge retaining means comprises an insert permanently secured within said cartridge insertion end of said chamber, with said insert having at least one inwardly disposed tab thereon; and said cartridge includes a head portion including a flange having at least one slot formed peripherally therein for clearing said tab of said insert when said cartridge is installed within said chamber, with said cartridge being secured within said chamber by turning said cartridge so that said flange is locked beneath said at least one tab of said insert.

5. The footwear with replaceable hygienic cartridge according to claim 1, wherein said channels in said upper surface of said sole comprise a longitudinal and lateral grid pattern.

6. The footwear with replaceable hygienic cartridge according to claim 1, wherein said passage is located at said internal end of said chamber.

7. The footwear with replaceable hygienic cartridge according to claim 1, wherein said cartridge has an innermost end for positioning adjacent said internal end of said chamber when said cartridge is installed therein, and said innermost end of said cartridge is porous.

8. The footwear with replaceable hygienic cartridge according to claim 1, wherein said shoe comprises an athletic shoe having a resilient heel.

9. The footwear with replaceable hygienic cartridge according to claim 1, wherein said heel of said shoe includes at least one side, and said chamber is laterally positioned in said heel with said open cartridge insertion end of said chamber being formed in said at least one side of said heel.

10. The footwear with replaceable hygienic cartridge according to claim 1, wherein said heel of said shoe includes a rearward end, and said chamber is longitudinally positioned in said heel with said open cartridge insertion end of said chamber being formed in said rearward end of said heel.

11. The footwear with replaceable hygienic cartridge according to claim 1, wherein said at least one chemical within said cartridge is selected from the group consisting of scents, deodorants, anti-bacterials, fungicidals, and desiccants.

12. A replaceable hygienic cartridge assembly comprising:

a flexible, resilient cartridge having at least one hygienic chemical therein, with said cartridge being porous throughout at least a portion thereof; and cartridge retaining means for selectively and removably retaining said cartridge within a chamber provided in the heel of a shoe, wherein said chamber includes an open cartridge insertion end and an opposite internal end, said cartridge retaining means includes an insert having at least one inwardly disposed tab thereon;

said cartridge further includes a head portion including a flange having at least one slot formed peripherally therein for clearing said tab of said insert when said cartridge is installed within the insertion end of the chamber, with said cartridge being secured within said chamber by turning said cartridge so that said flange is locked beneath said at least one tab of said insert.

13. The replaceable hygienic cartridge assembly according to claim 12, wherein said cartridge has an innermost end for positioning adjacent said internal end of said chamber when said cartridge is installed therein, and said innermost end of said cartridge is porous.

14. The replaceable hygienic cartridge assembly according to claim 12, wherein said at least one chemical within said cartridge is selected from the group consisting of scents, deodorants, anti-bacterials, fungicidals, and desiccants.

15. Footwear with a replaceable hygienic cartridge, comprising:

a shoe having a sole including a heel, said heel defining a cartridge chamber including an open cartridge insertion end and an opposite internal end, said sole further including an upper surface including a plurality of channels in communication with one another and including at least one exit port through said upper surface and an internal passage in communication with both at least one of said plurality of channels and said cartridge chamber; and a cartridge removably installed within said cartridge chamber, said cartridge having resilient and flexible walls and a porous portion residing within said cartridge chamber;

whereby, a fluid agent can be forced from said cartridge by intermittent compression of said heel and said cartridge removably installed therein due to ambulatory action by a wearer of said shoe.

16. The footwear with replaceable hygienic cartridge according to claim 15, including a porous insole disposed within said shoe and overlying said upper surface of said sole and said channels thereof.

17. The footwear with replaceable hygienic cartridge according to claim 15, including cartridge retaining means for selectively and removably retaining said cartridge within said chamber.

18. The footwear with replaceable hygienic cartridge according to claim 15, including a chemical agent contained within said cartridge for hygienically treating said shoe.

19. The footwear with replaceable hygienic cartridge according to claim 18, wherein said chemical agent is selected from the group consisting of scents, deodorants, anti-bacterials, fungicidals, and desiccants.

* * * * *